US005788231A

United States Patent [19]

To

[11] Patent Number: 5,788,231

[45] Date of Patent: Aug. 4, 1998

[54] GAME APPARATUS

[75] Inventor: Marshall Sik Hei To, Hong Kong, Hong Kong

[73] Assignee: Everbright Toys Manufacturing Co., Ltd., Hong Kong, Hong Kong

[21] Appl. No.: 581,277

[22] Filed: Dec. 29, 1995

[30] Foreign Application Priority Data

Jan. 20, 1995 [GB] United Kingdom ..... 9501165

[51] Int. Cl.[6] ..... A63F 7/00

[52] U.S. Cl. ..... 273/126 R; 273/129 W; 273/119 A; 273/126 A

[58] Field of Search ..... 273/126 R, 126 A, 273/108, 113, 118, 119, 121, 129 R, 129 V, 129 W

[56] References Cited

U.S. PATENT DOCUMENTS

| | | | |
|---|---|---|---|
| 1,994,845 | 2/1935 | Wies | 273/123 R X |
| 3,773,325 | 11/1973 | Crossman et al. | 273/126 A |
| 3,954,267 | 5/1976 | Freeman et al. | 273/126 A |
| 4,046,380 | 9/1977 | Goldfarb et al. | 273/119 R |
| 4,173,341 | 11/1979 | Olliges . | |
| 4,239,222 | 12/1980 | Hori | 273/129 W |
| 4,986,543 | 1/1991 | Heller | 273/121 A |
| 5,014,990 | 5/1991 | Kaser et al. | 273/128 R |
| 5,029,861 | 7/1991 | Driska | 273/126 A X |
| 5,064,196 | 11/1991 | Gottlieb | 273/121 A |
| 5,516,102 | 5/1996 | Polk, III et al. | 273/119 R |

FOREIGN PATENT DOCUMENTS

| | | |
|---|---|---|
| 1412942 | 11/1975 | United Kingdom . |
| 1498580 | 1/1978 | United Kingdom . |

*Primary Examiner*—Raleigh W. Chiu
*Attorney, Agent, or Firm*—Gunn, Lee & Miller, P.C.

[57] ABSTRACT

Game apparatus (10) comprising a body (11) which has a perforated playing surface (13) and a border (14) upstanding from and extending around the playing surface (13), said border (14) having two opposite openings (15). Two flippers (16) are provided on opposite sides of each opening (15), which are pivotable by an operating mechanism (17). A motor-driven fan unit is provided under the playing surface (13) for driving air through the perforated playing surface (13) in order to create an air cushion thereon. A disc (19) is to be placed on the playing surface (13), while the fan unit is in action, for the flippers (16) at one opening (15) to strike to move into the other opening (15) and for flippers (16) at the other opening (15) to block against entry.

6 Claims, 4 Drawing Sheets

GAME APPARATUS

The present invention relates to game apparatus for two or more players.

SUMMARY OF THE INVENTION

According to the invention, there is provided game apparatus which comprises a body which has a substantially flat playing surface and a border upstanding from and extending around the playing surface, said playing surface having plurality of small holes and said border having at least two openings, a pair of flippers provided on opposite sides of each opening, said pair or flippers being pivotable in opposite directions on the playing surface, an operating mechanism for pivoting the flippers, a motor-driven fan unit provided under the playing surface for driving air through the holes in order to create an air cushion over the playing surfaces and a game piece to be placed on the playing surface, while the fan unit is in action, for the flippers at one opening to strike to move into the other opening and for the flippers at the other opening to block against entry.

Preferably, the part of the playing surface towards each opening is inclined at a small angle downwards.

More preferably, the junction between said parts of the playing surface is flatly bent for a smooth transition.

It is preferred liar each opening extends right to an adjacent edge of the body, Preferably, each flipper is arranged to be pivotable by means of an individual said operating mechanism.

More preferably, each operating mechanism includes a press-button for pivoting the corresponding flipper.

Even more preferably, the press-buttons are provided on an upper side of the body.

In a preferred construction each operating mechanism includes a pivotable member supported for angular movement, and the corresponding press-button is in angular-to-linear translational engagement with the pivotable member which is in turn in angular engagement with the corresponding flipper such that depression of the press-button will cause pivoting of the flipper.

Specifically, the pivotable member is supported for angular movement about a substantially vertical axis and has a radially extending part which is slidably engaged with a slanted slot formed in an adjacent side of the corresponding press-button.

In a specific construction, the operating mechanisms associated with each opening include a slider having at opposite ends respective inclined surfaces which are in sliding engagement from below with the corresponding press-buttons, said slider being resiliently biassed to move both press-buttons upwards.

Preferably, the fan unit is provided in a vertical position and centrally with respect to the playing surface.

It is an advantage that the game piece is in the form of a disc. The bottom side of the game piece may be recessed.

BRIEF DESCRIPTION OF DRAWINGS

The intention will now be more particularly described, by way of example only, with reference to the accompanying drawings, in which.

DETAILED DESCRIPTION OF PREFERRED EMBODIMENT(S)

Figure 1:
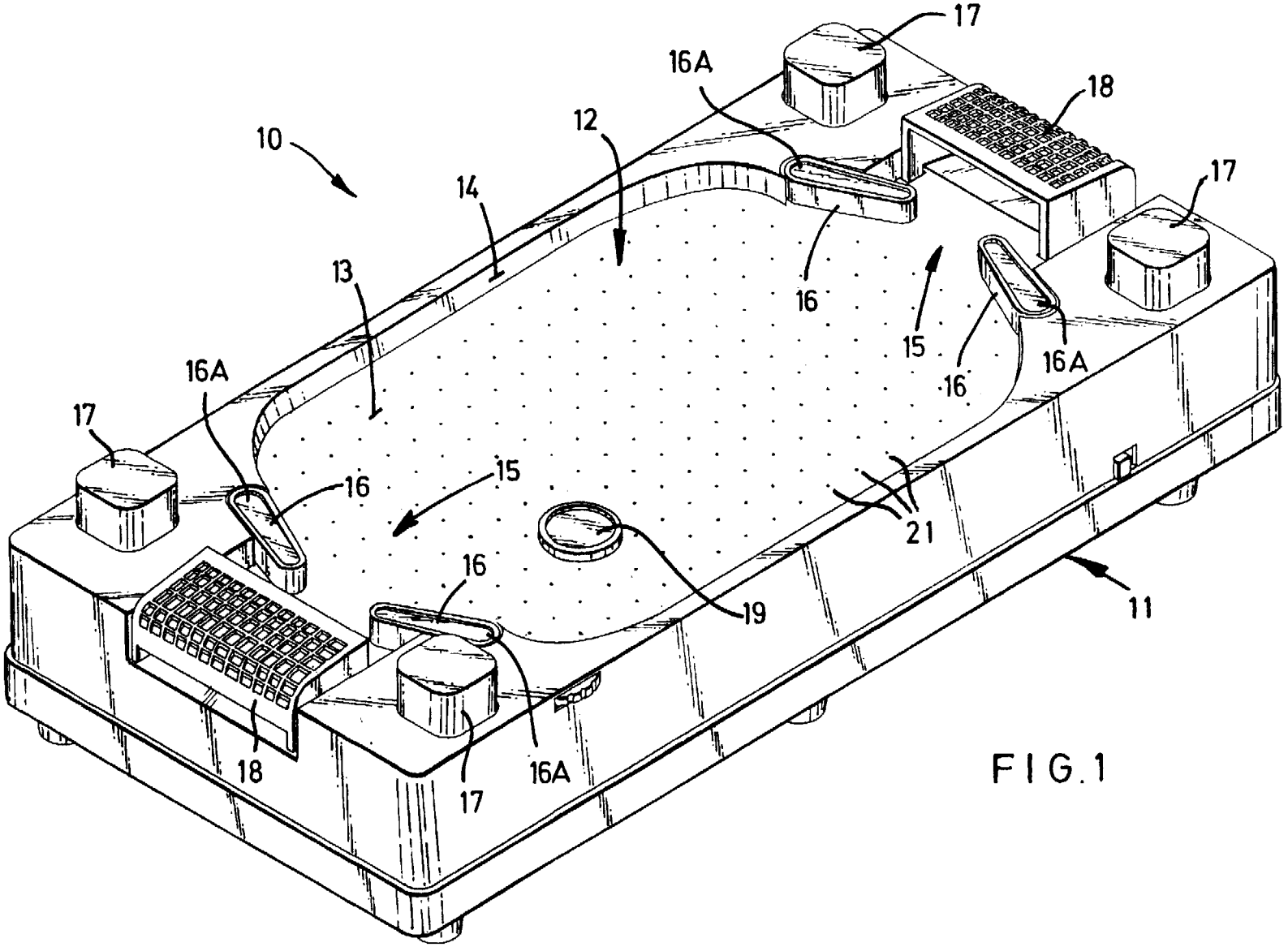
FIG. 1 is a perspective view of an embodiment of game apparatus in accordance with the invention.

Referring firstly to FIG. 1 of the drawings, there is shown game apparatus 10 embodying the invention, which apparatus 10 comprises a flat rectangular box-like plastic body 11 having on its top side a shallow oblong central recess 12. The bottom of the recess 12 (upper wall 11A of the body 11) provides a playing surface 13 which is generally flat and horizontal. The periphery of the recess 12 provides a border 14 upstanding from the playing surface 13. Opposite longer sides of the border 14 coverage to provide two ends which are broken to form respective openings 15. A pair of elongate flippers 16 are provided lying on opposite sides of each opening 15.

The flippers 16 of each pair are individually pivotable horizontally about their respective outer ends 16A, between a normal position (as shown) in which they are both inclined at an acute angle (about 20°) into the associated opening 15 and an active position (see FIG. 6) in which they are both inclined at an acute angle (about 20°) off the associated opening 15. Each flipper 16 is arranged to be activated by means of a corresponding press-button 17 which is provided at an adjacent corner of the apparatus body 11. Each opening 15 extend right to the corresponding shorter side of the body 11, and is covered by a decorative plastic net 18 which is removable and is through from front to back.

A game piece in the form of a plastic disk 19 is to be placed on the playing surface 13 for a first player using the flippers 16 at one end of the apparatus body 11 to hit or strike, thereby setting the disk 19 in motion, towards the opposite opening 15, either directly or through bouncing at the border 14. The flippers 16 at the opposite end of the body 11 are to be used by a second player to block the coming disc 19 against entering into the associated opening 15 and to strike the disc 19 back. Should the blocking fail, the disc 19 will pass through the opening 15, under the net 18 from front to back, and then fly off the body shorter side. This results in a score for the first player.

Figure 2:
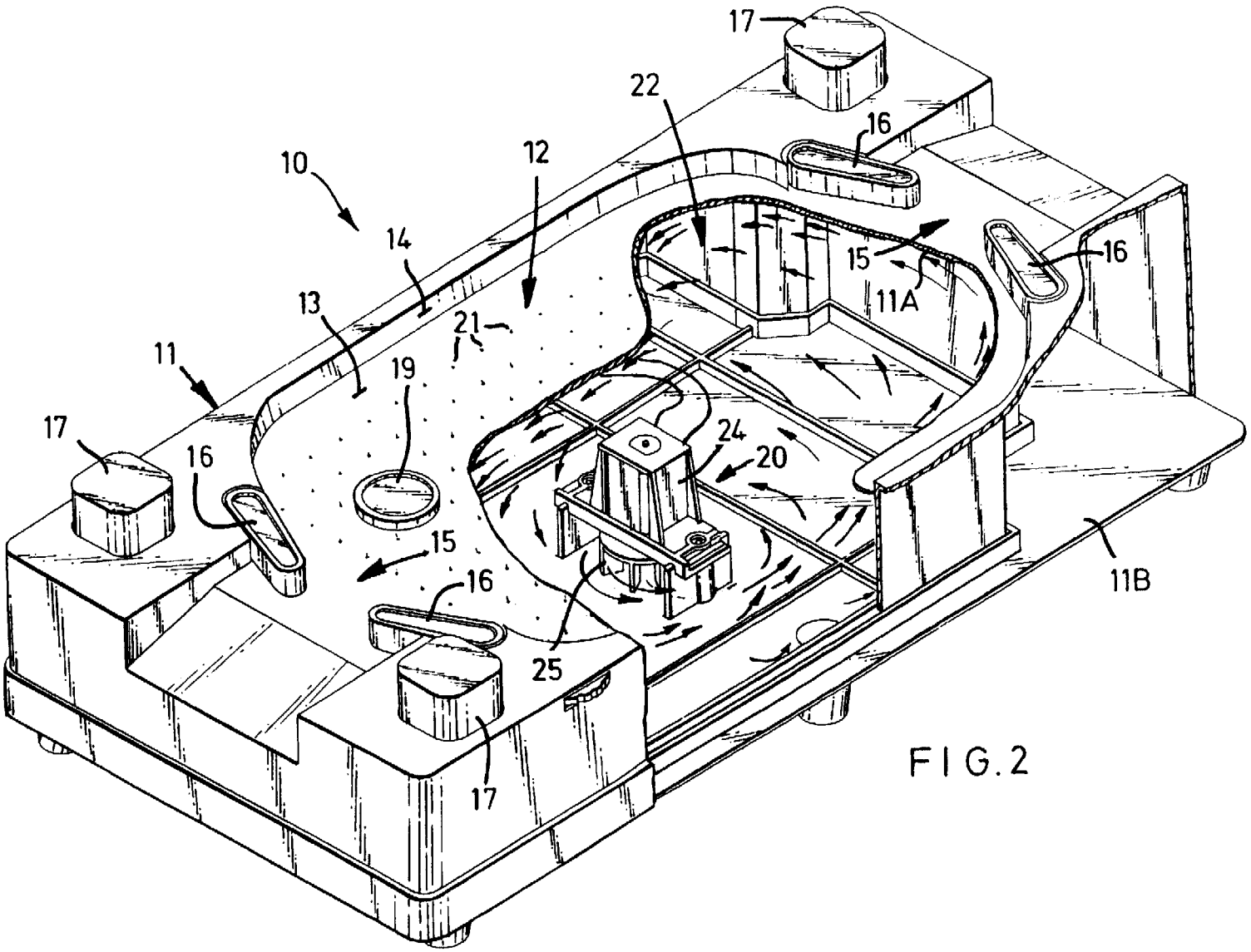
FIG. 2 corresponds to FIG. 1, showing the game apparatus partially broken.
Figure 3:
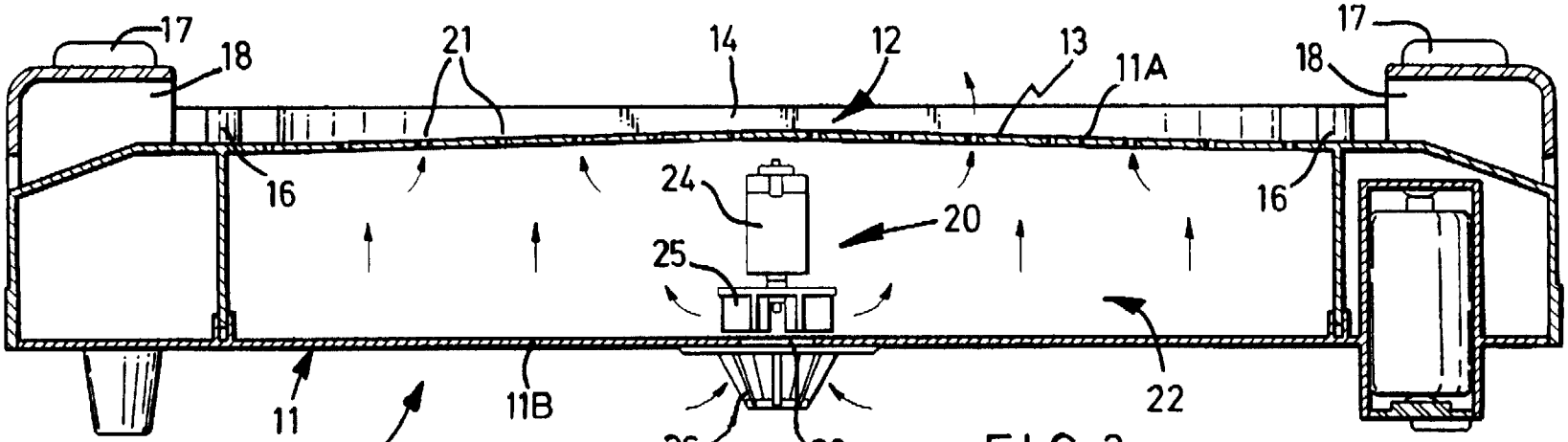
FIG. 3 is a cross-sectional side view of the game apparatus of FIG. 1.
Figure 4:
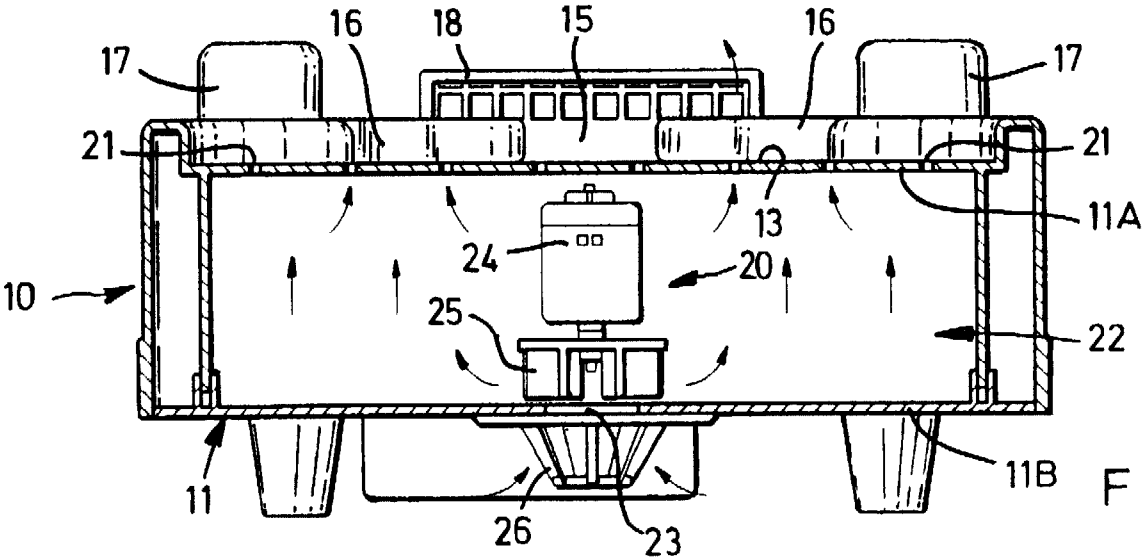
FIG. 4 is a cross-sectional end view of the game apparatus of FIG. 1.

Reference is now made to FIGS. 2 to 4 of the drawings. The game apparatus 10 is provided with a motor-driven fan unit 20 located centrally inside the apparatus body 11, underneath the playing surface 13. The playing surface 13 is provided with a relatively large number of small holes 21. The holes 21 are spread in an orderly manner all over the playing surface 13, except at the two openings 15. A chamber 22 is formed inside the body 11 below the perforated area of the playing surface 13. The chamber 22 is substantially air-tight, apart from the holes 21 and except at the centre of base wall 11B of the body 11, where an aparature 23 is formed. The fan unit 20 is formed by an electric motor 24 and a centrifugal fan 25 driven by the motor 24. It is mounted in a vertical position co-axially over the aperature 23, with the fan 25 facing downwards and as close as possible to the aperture 23. The underside of the aperture 23 is protected by a cage-like guard 26. Upon energization, the motor 24 rotates the fan 25 in order to draw air through the aperture 23 into the chamber 22, which air is then driven or compelled by the fan 25 to escape upwards through the holes 21, thereby providing a layer of air cushion over the playing surface 13 for cushioning the disc 19 such that the disc 19 can slide smoothly over the playing surface 13. Both sides of the disc 19 are recessed such that either side may be used as the bottom side to trap air of the air cushion for a better cushioning effect.

The upper wall 11A of the apparatus body 11, which provides thereon the playing surface 13, is inclined downwards at a very small angle (between 1° and 3° ) symmetrically in opposite directions towards the two corresponding openings 15. The junction between the oppositely inclined sides of the playing surface 13 is flatly bent for a smooth transition. Such a double-inclined arrangement of the playing surface 13 ensures that the disc 19, when air-cushioned, will not stop at any position over the playing surface 13 but to slide, even very slowly, towards the border opening 15 (and the associated flippers 16). The border 14 converging on opposite sides of the opening 15 serves to guide the disc 19 to reach the flippers 16 such that the flippers 16 can block the disc 19 and/or strike the disc 19 back.

Figure 5:
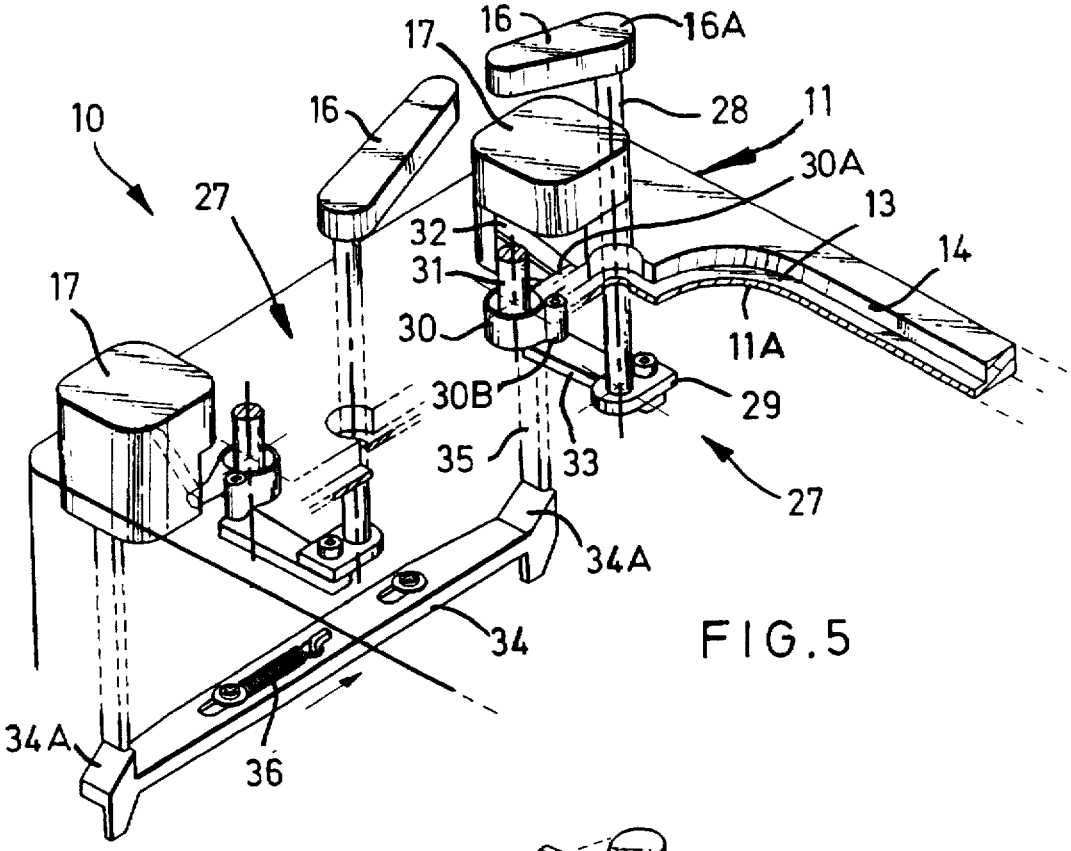
FIG. 5 is a perspective view of an operating mechanism of the game apparatus of FIG. 1, in a normal operating condition.
Figure 6:
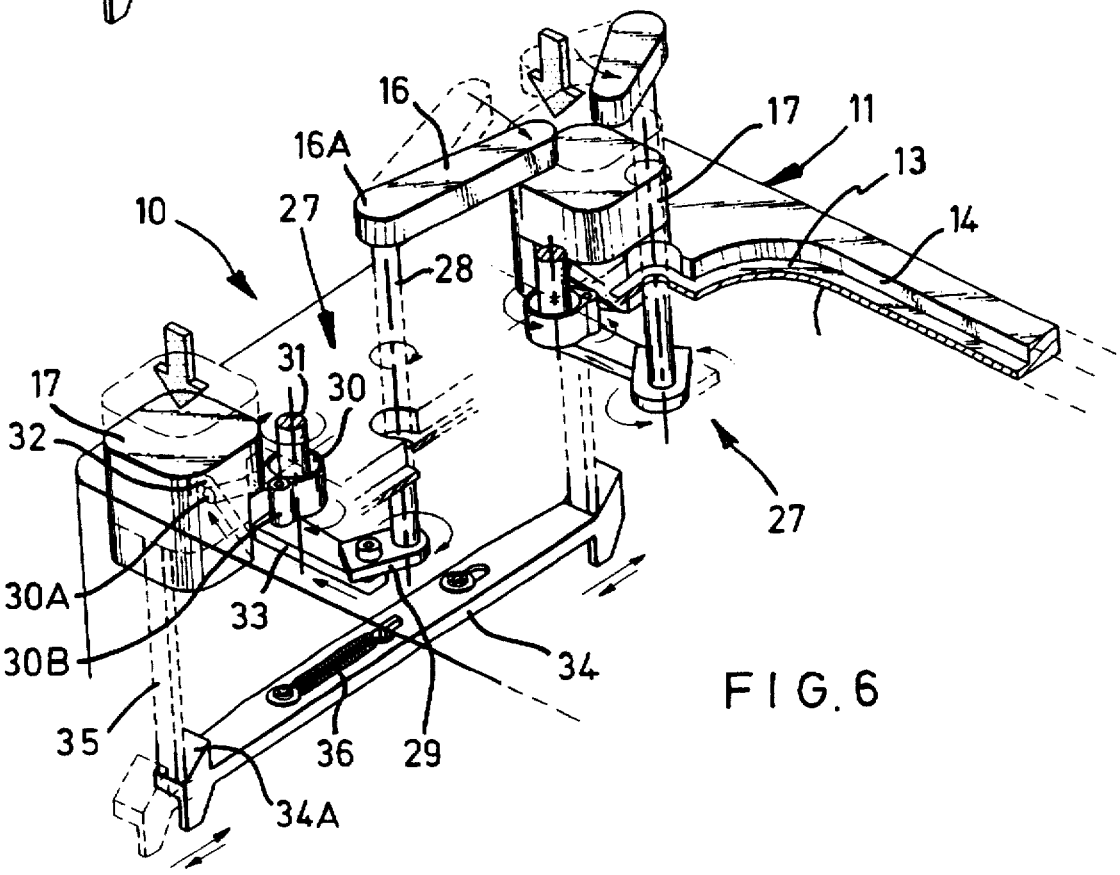
FIG. 6 corresponds to FIG. 5, showing the operating mechanism in an activated operating condition.

Referring finally to FIGS. 5 and 6 of the drawings, the operation of each press-button 17 upon the respective flipper 16 is effected by means of an individual operating mechanism 27. Each operating mechanism 27 is formed by a vertical shaft 28 which is fixed at its upper end at right angles to the outer end 16A of the associated flipper 16, and by a foot 29 fixed radially to the lower end of the shaft 28. The operating mechanism 27 includes a relatively short tubular member 30 which is supported for angular movement about a fixed post 31 and has a pair of radially extending integral projections 30A and 30B. The first projection 30A is in the form of a bar which extends into a slanted (at about 45°) slot 32, for sliding engagement therewith, formed in an adjacent side of the associated press-button 17. A elongate link 33 is hingedly connected at opposite ends to the second projection 30B and the foot 29.

Depression of the press-button 17 will cause rotation of the tubular member 30 through a certain angle by reason of the linear-to-angular translational engagement between the slot 32 and the first projection 30A. This angular motion is then transmitted by the link 33 to the shaft 28 and hence the flipper 16, whereby the flipper 16 pivots from its normal position (as shown by dotted lines in FIG. 6) to its activated position (as shown by solid lines in FIG. 6).

The two flippers 16 at each end of the apparatus body 11 are resiliently biassed to their normal positions by means of a elongate slider 34 acting upon the corresponding press-buttons 17. The slider 34 has at opposite ends thereof two co-parallel inclined (at about 45°) surfaces. Each of the two press-buttons 17 has a vertical leg 36 which bears downwards slidably against a corresponding inclined surface 34A of the slider 34. The slider 34 is resiliently biassed by an extension spring 36 to a normal position (as shown in FIG. 5) such that both legs 35 are lifted up to engage the upper ends of the corresponding inclined surfaces 34A.

Upon depression of any one (or both) of the press-buttons 17, the corresponding leg 35 will move vertically down to reach the lower end of the associated inclined surface 34A, against the action of the spring 36, thereby sliding the slider 34 into a position as shown by solid lines in FIG. 6. Upon release of the press button 17 concerned, the slider 34 returns to its normal position (as shown by dotted lines in FIG. 6) under action of the spring 36, thereby lifting the press-button 17 back to the original position. Throughout this operation, the undepressed press-button 17 will stay in position by reason of inherent fiction existing in the various connections or engagements through the operating mechanism 27.

It is appreciated that each press-button 17 may be resiliently biassed upwards by an internal compression spring (not shown).

In a different embodiment of the game apparatus, the border may have three or more openings, equi-angularly spaced, for more than two players to play.

The invention has been described by way of example only, and various other modifications of and/or alterations to the described embodiment may be made by persons skilled in the art without departing from the scope of the invention as specified in the appended claims.

What is claimed is:

1. Game apparatus comprising a body which has a substantially flat playing surface and a border upstanding from and extending around the playing surface, said playing surface having a plurality of small holes and said border having at least two openings, a pair of flippers provided on opposite sides of each opening, said pair of flippers being pivotable in opposite directions on the playing surface, an operating mechanism including a press-button for pivoting each flipper, a motor-driven fan unit provided under the playing surface for driving air through the holes in order to create an air cushion over the playing surface, and a game piece having a generally flat undersurface for movement by the flippers to glide on the air cushion, wherein each operating mechanism includes a pivotable member supported for angular movement and in angular engagement with the corresponding flipper, with which pivotable member the corresponding press-button is in linear-to-angular translational engagement such that depression of said press-button will cause pivoting of said flipper, said pivotable member having a radially extending part engaged slidably with a slanted slot formed in an adjacent side of the corresponding press-button.

2. Game apparatus as claimed in claim 1 wherein each operating mechanism further includes a link provided between the pivotable member and the corresponding flipper for transmitting angular movement.

3. Game apparatus as claimed in claim 1, wherein the operating mechanisms associated with each opening include a slider having at opposite ends respective inclined surfaces which are in sliding engagement from below with the corresponding press-buttons, said slider being resiliently biased to move both press-buttons upwards.

4. Game apparatus comprising a body which has a substantially flat playing surface and a border upstanding from and extending around the playing surface, said playing surface having a plurality of small holes and said border having at least two openings, a pair of flippers provided on opposite sides of each opening, said pair of flippers being pivotable in opposite directions on the playing surface, an operating mechanism for pivoting the flippers, a motor-driven fan unit provided under the playing surface for driving air through the holes in order to create an air cushion over the playing surface, and a game piece having a generally flat undersurface for movement by the flippers to glide on the air cushion, wherein each opening extends fully to an adjacent edge of the body such that the game piece may move off the body through a said opening:

wherein each said flipper is arranged to be pivotable by means of an individual said operating mechanism, each said individual operating mechanism further comprising a pivotable member supported for angular movement, a corresponding press-button in linear-to-angular translational engagement, and a link provided between said pivotable member and a corresponding flipper for transmitting angular movement such that depression of said press-button pivots said corresponding flipper, wherein said pivotable member is supported for angular movement about a substantially vertical axis and has a radially extending part which is slidably engaged with a slanted slot formed in an adjacent side of said corresponding press-button.

5. Game apparatus of claim 4 wherein each of said individual operating mechanisms comprise a slider having at opposite ends respective inclined surfaces in sliding engagement from below with said corresponding press-button, said slider resiliently biased to more said corresponding press-buttons upward.

6. Game apparatus of claim 4, wherein said fan unit is vertically and centrally positioned with respect to said playing surface.

* * * * *